US011162194B2

(12) United States Patent
Fischer et al.

(10) Patent No.: US 11,162,194 B2
(45) Date of Patent: Nov. 2, 2021

(54) DEVICE FOR MELT-SPINNING, DRAWING, AND WINDING A THREAD GROUP

(71) Applicant: OERLIKON TEXTILE GMBH & CO. KG, Remscheid (DE)

(72) Inventors: Martin Fischer, Solingen (DE); Jörg Hegenbarth, Remscheid (DE); Marc-André Herrndorf, Herne (DE); Linda Koormann, Remscheid (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 433 days.

(21) Appl. No.: 16/086,234

(22) PCT Filed: Mar. 14, 2017

(86) PCT No.: PCT/EP2017/055908
§ 371 (c)(1),
(2) Date: Sep. 18, 2018

(87) PCT Pub. No.: WO2017/162470
PCT Pub. Date: Sep. 28, 2017

(65) Prior Publication Data

US 2020/0291547 A1 Sep. 17, 2020

(30) Foreign Application Priority Data

Mar. 24, 2016 (DE) ..... 10 2016 003 722.9

(51) Int. Cl.
*D01D 13/02* (2006.01)
*D01D 5/08* (2006.01)
(Continued)

(52) U.S. Cl.
CPC ..... *D01D 13/02* (2013.01); *D01D 5/08* (2013.01); *D01D 7/00* (2013.01); *D01D 11/04* (2013.01)

(58) Field of Classification Search
None
See application file for complete search history.

(56) References Cited

U.S. PATENT DOCUMENTS 5,928,579 A * 7/1999 Spahlinger ..... B65H 54/20 264/40.1

FOREIGN PATENT DOCUMENTS

DE 10023910 11/2000
DE 102007014511 10/2008
(Continued)

OTHER PUBLICATIONS

English Translation of DE 102013003775A1 (Year: 2014).*

*Primary Examiner* — Timothy Kennedy
*Assistant Examiner* — Olukorede Esan
(74) *Attorney, Agent, or Firm* — BainwoodHuang

(57) ABSTRACT

A device for melt-spinning, drawing, and winding a thread group includes a spinning device having a row of spinning nozzles. The threads produced by the spinning nozzles are drawn by means of a godet device with multiple drivable godets. The device is paired with a winding device with multiple winding stations arranged in a row. The row of winding stations is arranged orthogonally to the row of spinning nozzles. The different thread spacings within the spinning device and the godet device are bridged by a thread deflecting device having a first group of thread guides and a second group of thread guides. The thread guides of the first group are arranged next to one another in a horizontal row with a spinning spacing. It is possible to obtain large deflections with a low height. The thread guides of the two groups are made of freely rotatable rollers.

9 Claims, 4 Drawing Sheets

(51) Int. Cl.
*D01D 7/00* (2006.01)
*D01D 11/04* (2006.01)

(56) References Cited

FOREIGN PATENT DOCUMENTS

| | | | | |
|---|---|---|---|---|
| DE | 102013003775 | A1 * | 11/2014 | ..... D01D 5/08 |
| EP | 1871930 | | 1/2008 | |
| WO | 2004015173 | | 2/2004 | |
| WO | 2015024817 | | 2/2015 | |

* cited by examiner

DEVICE FOR MELT-SPINNING, DRAWING, AND WINDING A THREAD GROUP

The invention relates to a device for melt-spinning, drawing, and winding a thread group as disclosed herein.

A generic device for melt-spinning, drawing, and winding a thread group is known from WO 2004/015173.

In order to produce synthetic threads, it is generally known that a thread group of a plurality of threads are spun next to one another in parallel within a spinning position, stretched, and wound to spools. The device known from WO 2004/015173 is used in particular for this purpose. The generic device has for this purpose a spinning device, which comprises a row of a plurality of spinning nozzles. Located underneath the spinning device is a godet device having at least two drivable godets and a winding device having a plurality of winding points. In this case, the godet device is directly assigned to the winding device, wherein the godets are aligned substantially transversely to the spool spindles of the winding device. A plurality of winding points extend along the spool spindles, the row thereof being kept substantially orthogonal to the row of spinning nozzles of the spinning device. As a result of such an assignment of the godet device and the winding device, very compact designs are possible.

Now, during the production of threads it is necessary that the threads are guided from the melt-spinning as far as the winding with different thread spacings in the thread group. In order in particular to bridge the transitions between a guide having a large thread spacing to a guide having a small thread spacing, thread deflecting devices are used. The known device thus has a thread deflecting device between the spinning device and the godet device, which is formed from two groups of thread guides. A first group of thread guides is assigned to the spinning device in order to guide the threads in a spinning spacing. A second group of thread guides is assigned to the godet device in order to bundle together the thread group so that the threads can be guided in the circumference of the godets with a substantially smaller thread spacing. Here however, care should be taken to ensure that the deflection of the threads in particular at the external threads does not result in any undesirable variations of the thread tensions and therefore of the physical properties of the threads. Regardless of the number of threads, it is therefore assumed that after completion all the threads of the thread group have identical physical properties. In this respect, in the known device the number of spinning nozzles arranged in a row is substantially limited by permissible deflection angles at the thread.

It is therefore the object of the invention to further develop the generic device for melt-spinning, drawing, and winding a thread group in such a manner that regardless of the number of spinning nozzles held in a row and regardless of a maximum deflection angle, the highest possible uniformity in the production of the threads is achieved.

This object is solved according to the invention in that the thread guides of the two groups of thread guides are formed by freely rotatable rollers.

Advantageous further developments of the invention are defined by the features and feature combinations as disclosed herein.

The threads of the thread group can be guided in a substantially frictionless manner in the transition from the spinning device to the godet device. Here it has surprisingly been found that the degree of wraparound on the rollers, which is substantially proportional to the deflection angle, causes no variation of the physical properties. Thus, the threads can be guided substantially free from slippage without any major friction effect on the circumference of the rollers.

In order that the thread group can be guided with the narrowest possible thread spacing jointly on the circumference of the godets of the godet device, the further development of the invention is preferably implemented, in which the rollers of the second group of thread guides are disposed above one another and/or below one another with an offset. Thus, thread spacings between the threads which are smaller than the diameter of a roller can be achieved. Usual thread spacings for the guidance of the threads on a godet lie in the range of 4-8 mm. As a result of the offset arrangement of the rollers above one another or below one another, even smaller thread spacings between the threads of the thread group can be achieved.

In this case, the horizontal offset between the rollers of the second group of thread guides is preferably equal to the thread spacing, so that the threads can be guided directly after run-off from the rollers on the circumference of the godets.

In order to obtain a compact arrangement of the rollers, it is furthermore provided that the rollers of the second group of thread guides are held in a central region underneath the spinning device in an inverse V-shaped row arrangement. The outer threads of the spinning device can thus be drawn from the spinning device and fed to the godet device under the same conditions.

For the thread guidance between the spinning device and the godet device as well as between the godet device and the winding device, it has furthermore proved particularly successful that the axes of the rollers of the two groups of thread guides and the axes of the godets are aligned orthogonally with respect to one another. Thus, a substantially frictionless guidance of the threads between the spinning device as far as the winding points of the winding device is possible.

The further development of the invention in which the spinning nozzles of the spinning device are held by two adjacently disposed spin beams and in which the rollers of the second group of thread guides are held in the central region between the spin beams is particularly suitable for simultaneously drawing several thread groups of neighboring spinning points and winding to spools. This embodiment of the invention is particularly suitable for modernizing available melt-spinning devices. Available spinning devices can thus be combined with new take-up systems.

In order to facilitate operation, the further development of the invention is provided in which the rollers of the second group of thread guides are held on one or two movable supports, which can each be guided between a spreading position of the rollers and an operating position of the rollers. The rollers can thus be held in such a manner that a manual thread guidance by means of a suction gun is possible for spreading the threads independently of the offset.

Thus, the support can preferably be held at one end on a pivot axis and can be guided in an angular range as far as a horizontal. Thus, the maximum spacing is available between the rollers to spread the threads on the rollers.

In order to obtain as compact as possible thread guidance in particular in the area of the godet device and the winding device, it is further provided that the godet device and the winding device are disposed in a central region underneath the spinning device and that the godet device is held at a front end of the winding device. The thread group can thus be supplied substantially from a horizontal plane to the individual winding points.

In the case of process interruptions as a result of abnormal behavior in the winding device, the further development of the invention in which the godet device has a thread suction device, which is disposed downstream of the rollers of the second group of thread guides in the thread run has proved particularly successful. Thus, the severing of the thread group in the event of a fault in one region is executed underneath the thread deflecting device. Thus, the threads are guided on the circumference of the rollers even in the event of a fault. A subsequent re-spreading is only required in the godet device and the winding device. Consequently, short interruption times can be achieved.

The invention will be explained in detail hereinafter by means of some exemplary embodiments with reference to the appended figures.

Figure 1:
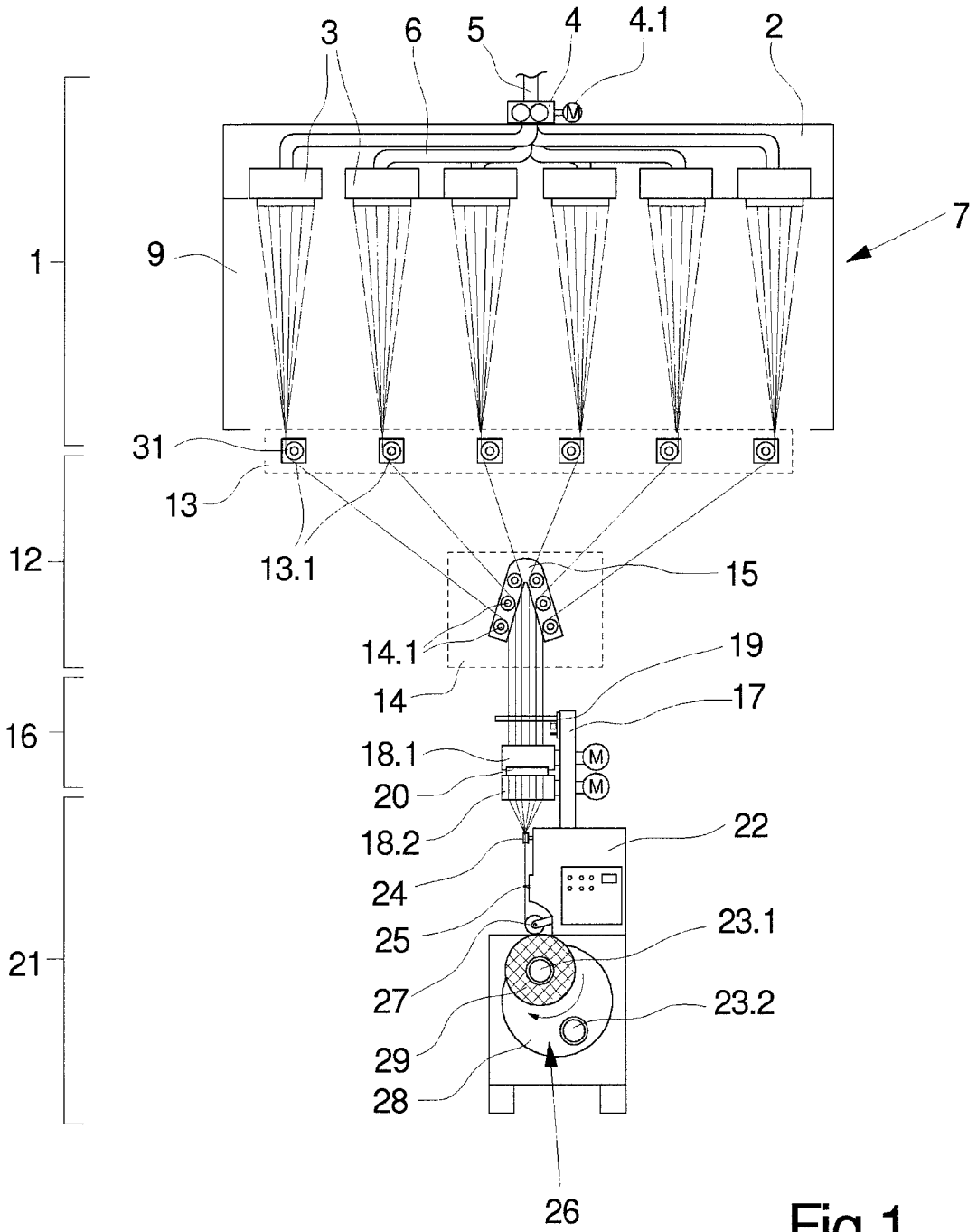
FIG. 1 shows schematically a front view of a first exemplary embodiment of the device according to the invention.
Figure 2:
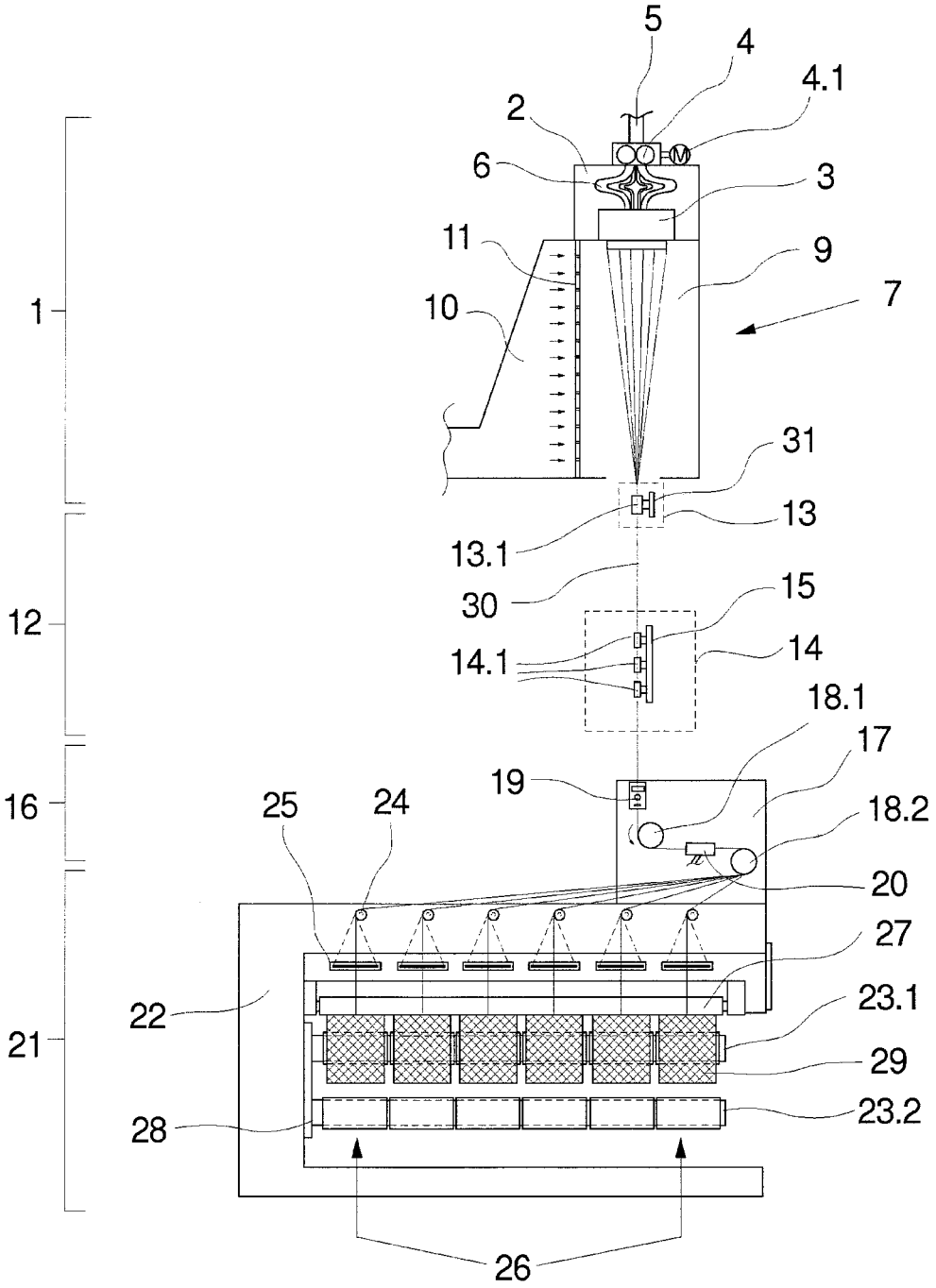
FIG. 2 shows schematically a side view of the exemplary embodiment from FIG. 1.

FIGS. 1 and 2 show a first exemplary embodiment of the device for melt-spinning, drawing, and winding a thread group according to the invention in several views. FIG. 1 shows the exemplary embodiment in a front view and FIG. 2 shows the exemplary embodiment in a side view. Insofar as no express reference is made to one of the figures, the following description applies to both figures.

The exemplary embodiment comprises a spinning device 1, a thread deflecting device 12, a godet device 16, and a winding device 21, which are arranged among one another.

The spinning device 1 has a plurality of spinning nozzles 3 for spinning multifilament threads, which are held in a row arrangement at a distance from one another on the underside of a spin beam 2. The spin beam 2 is designed to be heatable for temperature control of the spinning nozzles 3. A melt distributor system 6, which is connected to a spin pump 4, is formed inside the spin beam 2. The spin pump 4 is designed as a multiple pump in order to produce a partial melt flow to each spinning nozzle 3. For this purpose the spin pump 4 is driven by a pump drive 4.1.

The spin pump 4 is connected to a melt source not shown here, for example an extruder or a discharge pump via an intake 5.

Located underneath the spin beam 2 is a cooling device 7, which forms a cooling shaft 9 underneath the spin beam 2 for guiding and cooling the freshly extruded filament strands of the threads.

As can be seen from the diagram in FIG. 2, the cooling shaft 9 is assigned a one-sided blowing chamber 10, which is connected to the cooling shaft 9 via a blowing wall 11.

At this point it is expressly mentioned that the depicted cooling device with a transversely directed cooling air flow is exemplary. In principle, cooling devices of this type also comprise devices which blow a cooling air flow generated radially from inside to outside or radially from outside to inside onto the filaments.

The freshly extruded threads form a thread group 30, which is drawn by the godet device 16 from the spinning device 1. In this exemplary embodiment the godet device 16 comprises two driven godets 18.1 and 18.2, which are held on a godet support 17 in a projecting manner with their godet shells. The drives assigned to the godets 18.1 and 18.2 are held on the rear side of the godet support 17.

A suction device 19 is disposed in an inlet region upstream of the first godet 18.1. The suction device 19 has at least one movable thread guide, a blade, and a suction nozzle, which are not shown in detail here. Suction devices 19 of this type are sufficiently known and therefore are not described further at this point.

Between the godets 18.1 and 18.2 a turbulence device 20 is held on the godet support 17, through which the individual threads of the thread group 30 are swirled.

The godet support 17 is disposed directly on a front face of the winding device 21 so that the threads running out from the godet 18.2 are distributed from a substantially horizontal distribution plane onto a plurality of winding points 26. The godet support 17 is here supported directly on a machine frame 22 of the winding device 21.

The winding points 26 formed inside the winding device 21 are configured identically and extend along a spool spindle 23.1. The row of winding points 26 and therefore the spool spindles are disposed substantially orthogonally to the row of spinning nozzles 3 of the spinning device 1. Thus, a very compact arrangement of the godet device 16 and the winding device 21 is possible.

The spool spindle 23.1 is disposed on a rotatably mounted spool capstan 28, wherein the spool capstan 28 carries a second spool spindle 23.2 disposed in a manner offset by 180° . In this respect the spool spindles 23.1 and 23.2 alternately lead into a winding region and a changing region. In the winding region the spool spindles 23.1 and 23.2 cooperate with the respective winding points 26 in order to form a spool 29 on the circumference of the spool spindles 23.1 or 23.2 in each of the winding points 26.

The winding points 26 are constructed identically and each have a deflecting roller 24 and a traversing unit 25. The threads are separated by the deflecting rollers 24 and are then guided to and fro by means of the traversing unit 25. A pressing roller 27 which extends over all the winding points 26 is provided for spreading the threads on the circumference of the spools 29.

The thread deflecting device 12 is provided to bring the thread group together in the area between the spinning device 1 and the godet device 16. In this exemplary embodiment the thread deflecting device 12 comprises a first group of thread guides 13, which are formed by freely rotatable rollers 13.1 in each case. The rollers 13.1 of the first group of thread guides are assigned to the spinning nozzles 3 in order to bring together the filament strands of the respective threads at a so-called convergence point. In this respect the rollers 13.1 are held at a spinning distance from one another in a row-like arrangement in each case on a roller support 31. In principle, the rollers 13.1 can also be held on a single roller support.

Located underneath the first group of thread guides 13 is a second group of thread guides 14, which contain a plurality of rollers 14.1. The rollers 14.1 of the second group of thread guides 14 are disposed with an offset above one another and below one another in such a manner that an inverse V-shaped row arrangement is obtained. Here the rollers 14.1 are held on a V-shaped support 15, which is disposed in the central region of the row of spinning nozzles 3. The second group of thread guides 14 is assigned to the godet device 16 in such a manner that the threads can be guided between the rollers 14.1 and the first godets 18.1 without deflection.

As is deduced in particular from FIG. 1, the horizontal offset formed between neighboring rollers 14.1 of the second group of thread guides 14 is equal to a thread spacing of neighboring threads. The threads of the thread group 30 can thus be supplied independently of the diameter of the rollers 14.1 with a relatively small thread spacing with respect to one another directly to the godets 18.1 and 18.2 of the godet device 16. The thread group is in this case preferably guided with a thread spacing between the threads in the range of 4 mm to 8 mm. The rollers 14.1 of the second group of thread guides 14 are aligned with their axes orthogonal to the axes of the godets 18.1 and 18.2 for this purpose.

In the exemplary embodiment shown in FIGS. 1 and 2, the number of the selected spinning nozzles 3 in the spinning device 1 as well as the number of winding points 26 in the winding device 21 is exemplary. Thus, here the devices are designed to produce six threads. In principle, spinning devices of this type can also produce twice as many threads at the same time. The row-like arrangement of the spinning nozzles 3 as well as the row-like arrangement of the winding points 26 remains unchanged here so that the winding points 26 extend substantially orthogonally to the row of spinning nozzles 3.

In the diagrams in FIGS. 1 and 2 the devices are shown in operation. Here a plurality of filament strands is extruded from a polymer melt via the spinning nozzles 3 continuously per spinning nozzle. For this purpose each of the spinning nozzles 3 is fed a partial melt flow of polymer melt under pressure via the spinning pump 4. After extrusion of the filament strands, these are cooled and consolidated inside the cooling shaft 9. In this case, the thread group is drawn continuously through the godets 18.1 and 18.2 of the godet device 16. The threads are brought together from a spinning spacing of the spinning device to a treatment spacing of the godet device 16 through the rollers 13.1 of the first group of thread guides 13 and the rollers 14.1 of the second group of thread guides 14. Here short spacings between the godet device 16 and the spinning device 1 can be achieved. Thus, in particular the external threads of the thread group 30 can be drawn with a relatively large deflection angle from the spinning device 1 and then supplied to the godet device 16. The spacing between the spinning device and the godet device can be shortened proportionately by the size of the deflection of the threads.

Inside the godet device 16 the threads are stretched and swirled and then supplied to the winding points 26. In the winding points each of the threads is wound to a spool. As a result of the substantially frictionless deflection at the freely rotatable rollers 13.1 and 14.1 of the thread deflecting device 12, the physical properties of the threads are substantially the same and constant. In this respect, the device according to the invention is particularly suitable for drawing a fairly large number of threads from a spinning device 1.

Figure 3:
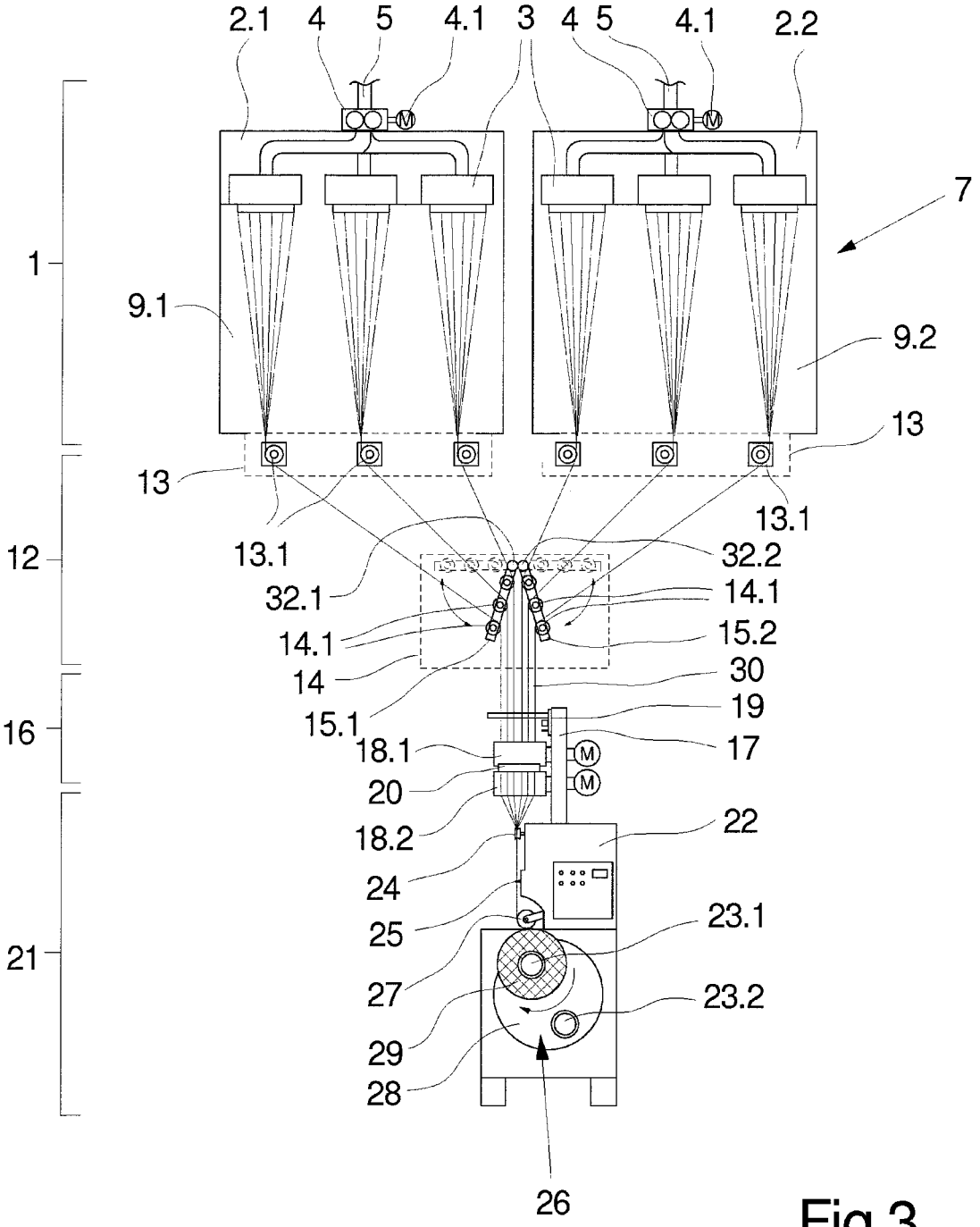
FIG. 3 shows schematically a front view of a further exemplary embodiment of the device according to the invention.

FIG. 3 shows an exemplary embodiment in which the spinning nozzles 3 are arranged in a distributed manner on two spin beams 2.1 and 2.2. The spin beams 2.1 and 2.2 are disposed next to one another. The spin beams 2.1 and 2.2 are assigned separate spinning pumps 4, which are connected to the spinning nozzles 3 held on the respective spin beam 2.1 and 2.2.

Respectively one cooling device 7 is provided underneath the spin beam 2.1 and 2.2, which cooling device comprises two cooling shafts 9.1 and 9.2 formed next to one another. The cooling shafts 9.1 and 9.2 are connected to blowing devices not shown here to produce cooling air. For drawing the threads produced at the two spin beams, there is provided a godet device 16 and a winding device 21, which in this exemplary embodiment are identical to the aforesaid exemplary embodiment. In this respect, reference is made to the aforesaid description to avoid repetitions.

The thread group 30 is also brought together between the spinning device 1 and the godet device 16 by the thread deflecting device 12 formed from two groups of thread guides 13 and 14. In this exemplary embodiment, the first group of thread guides 13 is split into two sub-groups, wherein a first sub-group is assigned to the spin beam 2.1 and a second subgroup is assigned to the spin beam 2.2. The rollers 13.1 of the first group of thread guides 13 are therefore directly assigned to one of the spinning nozzles 3 on the spin beams 2.1 and 2.2.

The second group of thread guides 14 is held in the central region between the spin beams 2.1 and 2.2. In this exemplary embodiment the second group of thread guides 14 is formed by freely rotatable rollers 14.1, which are disposed above one another and below one another. For this purpose one sub-group of rollers 14.1 is held on a first support 15.1 and a second sub-group of rollers 14.1 is held on the support 15.2. The supports 15.1 and 15.2 are each held on a pivot axis 32.1 and 32.2 in an inverse V-shaped arrangement. The supports 15.1 and 15.2 can thus be guided between an operating position and a spreading position. FIG. 3 shows the operating position of the supports 15.1 and 15.2 in which the rollers 14.1 occupy an operating position. The spreading position of the supports 15.1 and 15.2 is shown by dashed lines, in which the rollers 14.1 are held in a spreading position. This design is particularly advantageous in order to spread the thread group on the rollers 13.1 and 14.1 of the thread deflecting device 12 at the beginning of the process.

The function of the exemplary embodiment shown in FIG. 3 is identical to the exemplary embodiment according to FIGS. 1 and 2. In this respect, reference is made to the aforesaid description.

The exemplary embodiment shown in FIG. 3 is particularly suitable for jointly taking up threads extruded in neighboring spinning points as a thread group and being able to wind to spools by means of a winding device.

Figure 4:
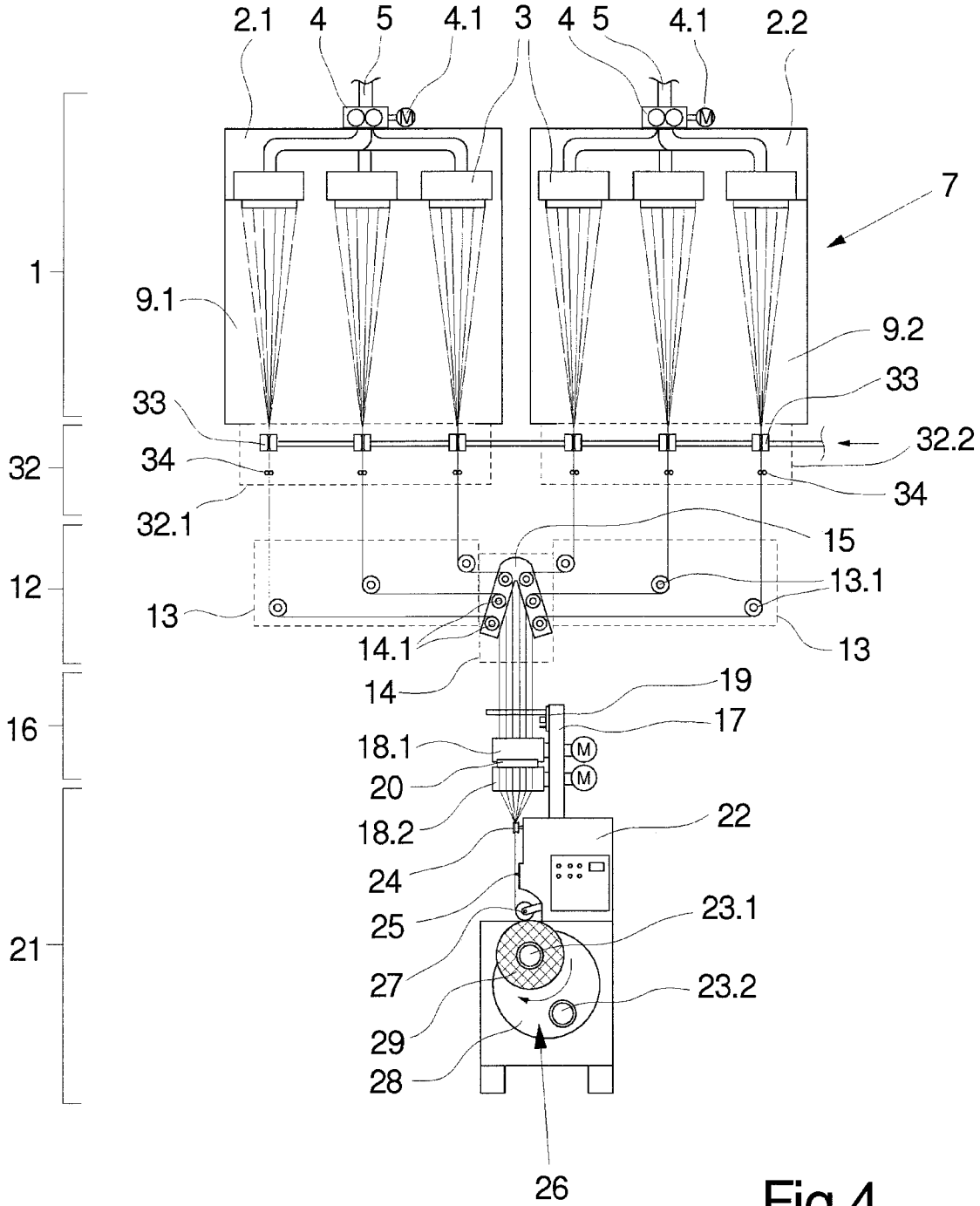
FIG. 4 shows schematically a front view of a further exemplary embodiment of the device according to the invention.

FIG. 4 shows a further exemplary embodiment of the device according to the invention schematically in a front view. The exemplary embodiment consists of a spinning device 1, a preparation device 32, a thread deflecting device 12, a godet device 16, and a winding device 21. The spinning device 1, the godet device 16, and the winding device 21 are implemented identically to the exemplary embodiment according to FIG. 3 so that at this point reference is made to the aforesaid description and no further explanations are given at this point to avoid repetitions.

In order to bring together filament strands extruded from the spinning nozzles 3 to form a thread in each case, respectively one preparation device 32.1 and 32.2 is disposed underneath the cooling shafts 9.1 and 9.2. Each of the preparation devices 32.1 and 32.2 shown has per thread a lubricator 33 and a collecting thread guide 34. Here the lubricator 33 and the collecting thread guide 34 each form a convergence point to the upstream spinning nozzle 3 in order to wet the filament strands and combine them to form a thread. The lubricators 33 are jointly or separately connected to a fluid source e. g. a metering pump.

Located underneath the preparation device 32 is the thread deflecting device 12 with two groups of thread guides 13 and 14. Each group of thread guides 13 and 14 comprises a plurality of rollers 13.1 and 14.1, which are disposed in an overlapping manner with respect to one another so that the threads of the thread group 30 are guided with identical wraparounds in the range of 90° on the rollers 13.1 and 14.1. The threads of the thread group 30 are thus guided on the rollers 13.1 of the first group of thread guides 13 with a wraparound angle in the range of 90° . Thus, the rollers 13.1 and 14.1 which are assigned to one of the threads lie at substantially the same working height.

For this purpose the rollers 14.1 of the second group of thread guides 14 are held on a V-shaped support 15 with an offset above one another to form a V-shaped row arrangement. The rollers 13.1 of the first group of thread guides are accordingly assigned to the rollers 14.1, wherein the rollers 13.1 with the respective collecting thread guides 34 located upstream in the thread run span a vertical thread run plane.

The function of the exemplary embodiment of the device according to the invention shown in FIG. 4 is identical to the aforesaid exemplary embodiments so that reference is made to the aforesaid description.

The exemplary embodiments of the thread deflecting device 12 shown in FIGS. 1 to 4 are possible arrangements of the two groups of thread guides in order to bring together the thread group of a plurality of spinning nozzles to the narrowest possible thread spacing. The rollers are preferably designed to be freely rotatable. In principle, however, it is also possible to drive at least one of the groups of rollers. In this respect, the spinning nozzles of a spinning point or of several neighboring spinning points can advantageously be bundled together and guided through a godet device with close pitch.

The invention claimed is:

1. A device for melt-spinning, drawing, and winding a thread group, comprising:

a spinning device, which has a row of spinning nozzles, a godet device, which has at least two drivable godets, a winding device which has a row of winding points, wherein the row of winding points is disposed orthogonally to the row of spinning nozzles, and a thread deflecting device disposed between the spinning device and the godet device, wherein the thread deflecting device has a first group of thread guides assigned to the spinning device and a second group of thread guides assigned to the godet device, wherein the thread guides of the first group are disposed next to one another in a horizontal row with a spinning spacing, and wherein the thread guides of the two groups of thread guides are formed by freely rotatable rollers;

wherein the rollers of the second group of thread guides are held on one or two movable supports, which can each be guided between a spreading position of the rollers and an operating position of the rollers.

2. The device as claimed in claim 1, wherein the rollers of the second group of thread guides are disposed above one another and/or below one another with an offset.

3. The device as claimed in claim 2, wherein the offset between the rollers of the second group of thread guides is equal to a thread spacing of the threads of the thread group on the circumference of one of the godets.

4. The device as claimed in claim 1, wherein the rollers of the second group of thread guides are held in a central region underneath the spinning device in an inverse V-shaped row arrangement.

5. The device as claimed in claim 1, wherein the axes of the rollers forming the thread guides of the second group and the axes of the godets are aligned orthogonally with respect to one another.

6. The device as claimed in claim 1, wherein the spinning nozzles of the spinning device are held by two adjacently disposed spin beams and wherein the rollers of the second group of thread guides are held in the central region between the spin beams.

7. The device as claimed in claim 5, wherein the one or two movable supports are each held by one end on a pivot axis and can be guided in an angular range as far as a horizontal.

8. The device as claimed in claim 5, wherein the godet device and the winding device are disposed in a central region underneath the spinning device and the godet device is held at a front end of the winding device.

9. The device as claimed in claim 7, wherein the godet device has a thread suction device, which is disposed downstream of the rollers of the second group of thread guides in the thread run.

* * * * *